US005192079A

United States Patent [19]

Sun et al.

[11] Patent Number: 5,192,079

[45] Date of Patent: Mar. 9, 1993

[54] GOLF BALL WITH SMALLER AND LARGER DIMPLES

[76] Inventors: Donald J. C. Sun, 4521 Ocean Valley La., San Diego, Calif. 92130; Eric C. P. Kuo, 14501 Maplewood St., Poway, Calif. 92064

[21] Appl. No.: 760,088

[22] Filed: Sep. 16, 1991

Related U.S. Application Data

[63] Continuation-in-part of Ser. No. 552,089, Jul. 13, 1990, Pat. No. 5,087,048.

[51] Int. Cl.[5] ..... A63B 37/14

[52] U.S. Cl. ..... 273/232; 40/327

[58] Field of Search ..... 273/232, 220; 40/327

[56] References Cited

U.S. PATENT DOCUMENTS

| | | | |
|---|---|---|---|
| 4,141,559 | 2/1979 | Melvin et al. | 273/232 X |
| 4,142,727 | 3/1979 | Shaw et al. | 273/232 |
| 4,560,168 | 12/1985 | Aoyama | 273/232 |
| 4,729,861 | 3/1988 | Lynch et al. | 273/232 X |
| 4,744,564 | 5/1988 | Yamada | 273/232 |
| 4,765,626 | 8/1988 | Gobush | 273/232 |
| 4,804,189 | 2/1989 | Gobush | 273/232 |
| 4,813,677 | 3/1989 | Oka et al. | 273/232 |
| 4,915,389 | 4/1990 | Ihara | 273/232 |
| 4,919,434 | 4/1990 | Saito | 273/235 R |
| 4,921,255 | 5/1990 | Taylor | 273/232 |
| 4,982,964 | 1/1991 | Morell | 273/232 |
| 4,998,733 | 3/1991 | Lee | 273/232 |
| 5,060,954 | 10/1991 | Gobush | 273/232 |
| 5,087,048 | 2/1992 | Sun et al. | 273/232 |

FOREIGN PATENT DOCUMENTS

| | | |
|---|---|---|
| 218311 | 4/1987 | European Pat. Off. . |
| 2157959 | 8/1986 | United Kingdom . |
| 2203954 | 11/1988 | United Kingdom . |
| 2205247 | 12/1988 | United Kingdom . |

*Primary Examiner*—George J. Marlo
*Attorney, Agent, or Firm*—William W. Haefliger

[57] ABSTRACT

A golf ball characterized by enhanced flight distance and enhanced aerodynamic symmetry, the ball having a generally spherical surface with dimple patterns thereon, the improvement comprising between about 75% and 85% of the ball spherical surface occupied by the dimples; there being smaller and larger dimples, all of which have diameters within the range of about 0.110 to 0.150 inches. Multiple great circle arcs on the ball surface define six-sided spherical surface hexagons on axially opposite polar zones. Smaller dimples within each such hexagons are grouped in clusters of four, symmetrically about an axis of the ball centrally intersecting the hexagons.

7 Claims, 3 Drawing Sheets

GOLF BALL WITH SMALLER AND LARGER DIMPLES

This application is a continuation-in-part of Ser. No. 552,089 filed Jul. 13, 1990, now U.S. Pat. No. 5,087,048.

BACKGROUND OF THE INVENTION

This invention relates to a golf ball, and more specifically, to a golf all with the characteristics of improved distance and improved aerodynamic symmetry. The golf ball has a dimpled surface with the dimples arranged on the ball surface within patterns created by a series of arcs of great circles. The patterns are such as to allow a large percentage of the surface of the ball to be covered by dimples and to minimize the negative aerodynamic effect of the undimpled equator, while still maintaining aerodynamic symmetry without the need for changing the depths of the dimples in the polar regions of the ball.

U.S. Pat. No. 4,744,564 discloses a means of achieving aerodynamic symmetry on a golf ball by decreasing the depth and therefore volume of dimples in the polar regions of the ball. It has long been known to those familiar with the art that for a given dimple size on a golf ball of a particular construction, there is one and only one depth which will optimize the performance of that ball in terms of distance. Changing the depth of the dimples in a particular region on the ball may improve the aerodynamic symmetry of the ball, but will have a detrimental effect on the distance of the ball.

U.S. Pat. No. 4,560,168 issued to Aoyama and U.S. Pat. No. 4,142,727 issued to Shaw et al. both disclose dimple patterns which achieve symmetry by having multiple great circles on the sphere which are dimple free, thus acting as false equators or parting lines. It is known to those skilled in the art, circumferential paths around the surface of the ball if maximum distance is to be achieved. This fact is pointed out in Uniroyal U.S. Pat. No. 1,407,730.

SUMMARY OF THE INVENTION

It is a major object of the invention to provide dimples of different sizes located in patterns on the ball surface, such that both enhanced flight distance and aerodynamic symmetry are achieved.

Basically, the ball has dimple patterns characterized by formation of great circles on the ball surface. Such arcs include spherical polygons (as for example hexagons) at the poles of the ball, and spherical triangles which touch the equator of the ball. On each half of the ball there are typically multiple spherical triangles each having a leg on the equator of the ball, and multiple spherical triangles, each of which has an apex on the equator of the ball.

The disclosed golf ball has two dimple sizes on its surface. The majority of the dimples are $0.140\pm0.002$ inches in diameter; and the minority of the dimples are $0.135\pm0.002$ inches in diameter. The combination of the locations of the arcs of the great circles and the placement of these smaller dimples is effective to achieve aerodynamic symmetry. The smaller dimples are somewhat deeper than the larger dimples having a ratio of depth to diameter of about 0.055 as compared to a ratio of about 0.047 for the larger dimples. More turbulence is created on the surface of the ball by these deeper dimples. Hence the flight of the ball in particular orientations can be affected by the location or placement of these dimples on the ball.

These and other objects and advantages of the invention, as well as the details of an illustrative embodiment, will be more fully understood from the following specification and drawings, in which:

DRAWING DESCRIPTION

DETAILED DESCRIPTION

Figure 1:
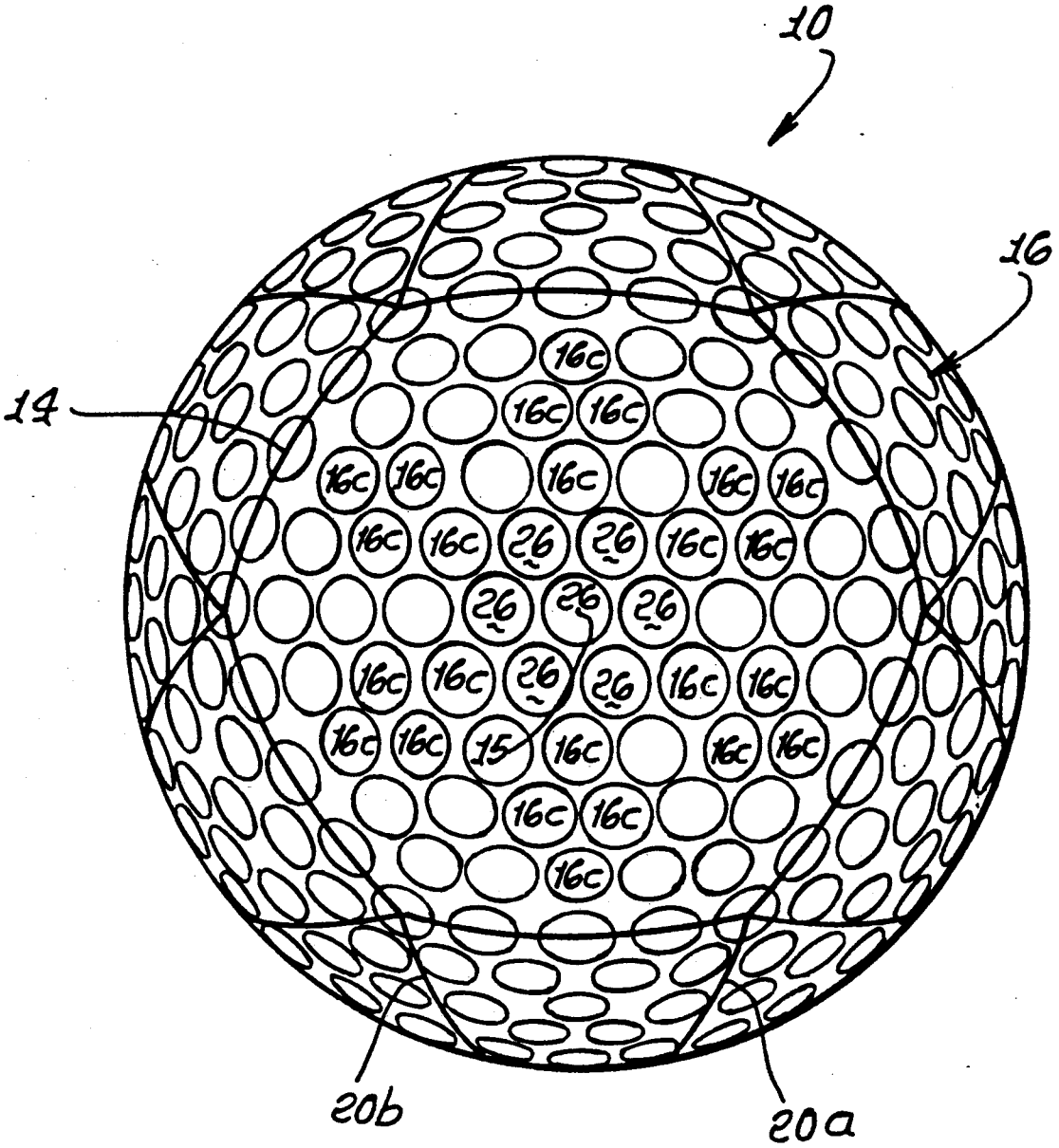
FIG. 1 is a polar view of one hemisphere showing the dimple pattern of this invention, the opposite polar view being the same.

In the drawings, a golf ball 10 is of standard size, as for example 1.68 inches in diameter. It has opposite polar regions at 11 and 12, and an equator, as indicated by great circle 13.

There are dimples of two different-sizes on or associated with the ball surface, and typically between about 75% and 85% of the ball surface is occupied by such dimples. More specifically, and preferably, as enabled by the invention, between about 78% and 82% of the ball surface is covered with the dimples.

The golf ball, as shown, has two dimple sizes on its surface. The majority of the dimples are $0.140\pm0.002$ inches in diameter. The minority of the dimples are $0.135\pm0.002$ inches in diameter. Further, there are 144 of the smaller dimples, and 314 of the larger dimples.

The smaller dimples are somewhat deeper than the larger dimples having a ratio of depth to diameter of about 0.055 compared to a ratio of about 0.047 for the larger dimples. More turbulence is created on the surface of the ball by these deeper dimples. Hence the flight of the ball in particular orientations can be affected by the location or placement of these dimples on the ball.

It has been discovered if dimples on the surface of a golf ball are constrained by a polygon of "n" sides at the pole of the ball, there should be $n^2$-2n of the aforementioned smaller and deeper dimples near each pole of the ball and $n^2+2n$ of the smaller and deeper dimples on each side of the equator of the ball in order to achieve optimum aerodynamic symmetry.

As an example, a spherical surface polygon, as for example a hexagon, is defined by equal length great circle arcs 14 spaced equally from the ball axis 15. Such arcs are characterized in the example as intersecting mid-portions of the larger dimples in rows (five in a row); and a similar polygon, as for example a hexagon, is defined at the opposite polar region of the ball. Each such hexagon is within the scope of a polygon of "n" sides, "n" being six in this case. The smaller dimples 16 are distributed in six clusters equally spaced about axis 15, as seen in FIG. 1, there being four smaller dimples 16c in each cluster. One group of five larger dimples 26 is spaced about and closest to axis 15, inwardly of the six clusters of smaller dimples. A large size dimple is also located at the exact pole. The total number of smaller dimples within the hexagon is 24, satisfying the formula $6^2-2\times6$.

Figure 4:
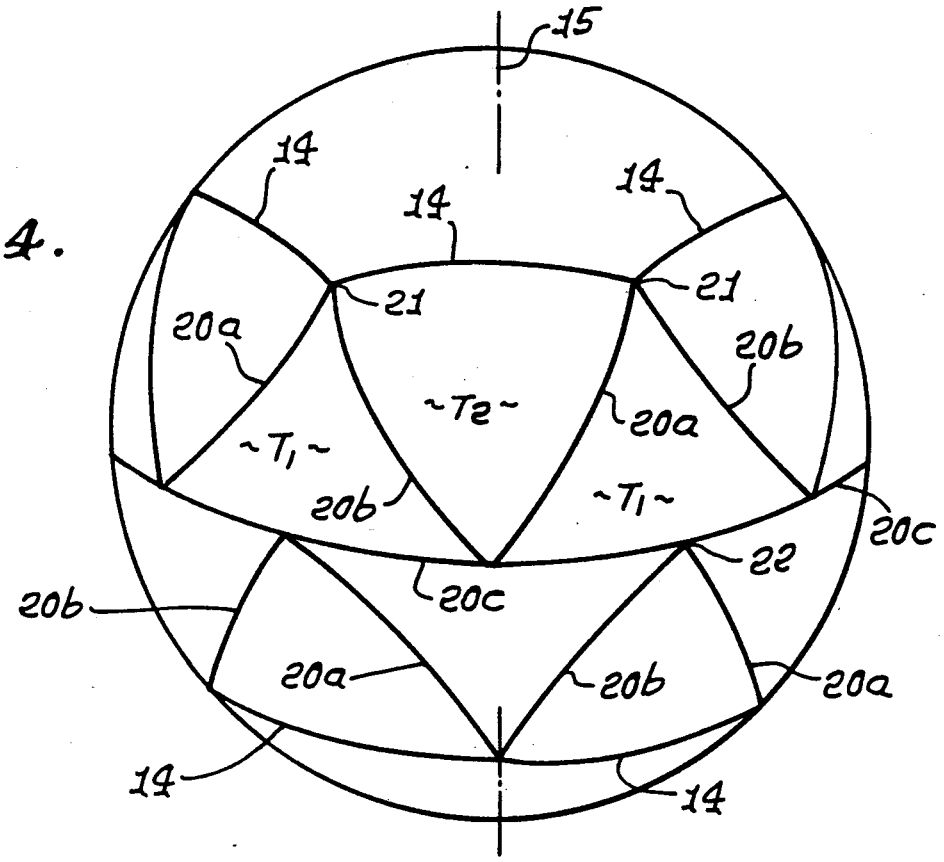
FIG. 4 is a side view of one hemisphere, like FIG. 2, with no dimples shown but with great circle arcs illustrated.

Further, in FIG. 4, the great circle arcs shown form spherical surface triangles; i.e., note like triangles $T_1$ formed by arcs 20a, 20b, and 20c, and like triangles $T_2$ formed by arcs 20a, 20b and 14. Six arcs 20c form the complete equator; and the six triangles $T_1$, plus the six triangles $T_2$, form a band about the ball surface between the equator and the two hexagons. This construction is the same for each of the upper and lower hemispheres of the ball. See also arc intersections 21 and 22.

Figure 2:
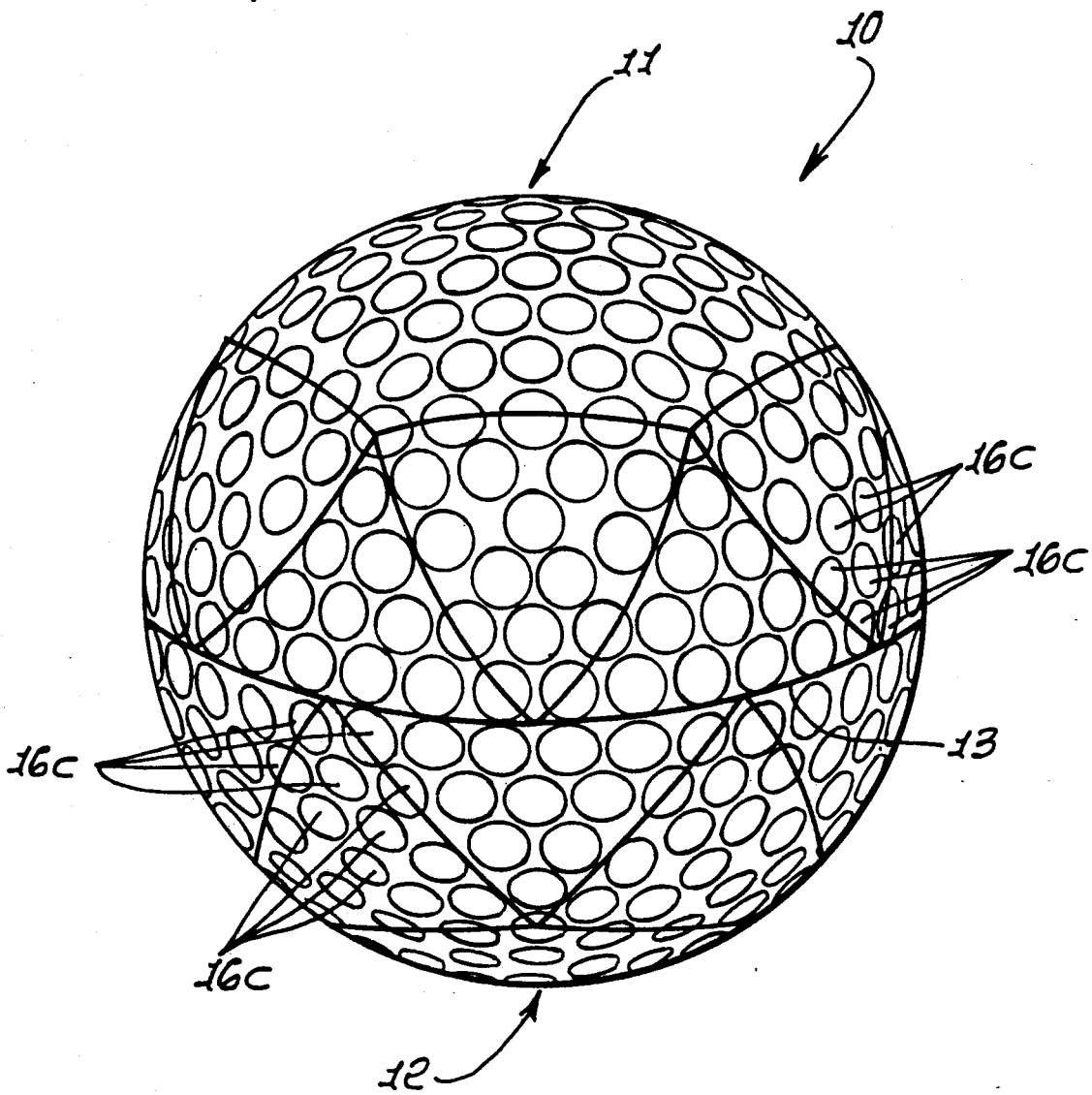
FIG. 2 is a side view of the hemisphere showing the dimple pattern of the invention at ball equatorial regions, the opposite hemisphere being the FIG. 3 is a polar view like FIG. 1 with no dimples shown, but with great circle arcs illustrated.
Figure 3:
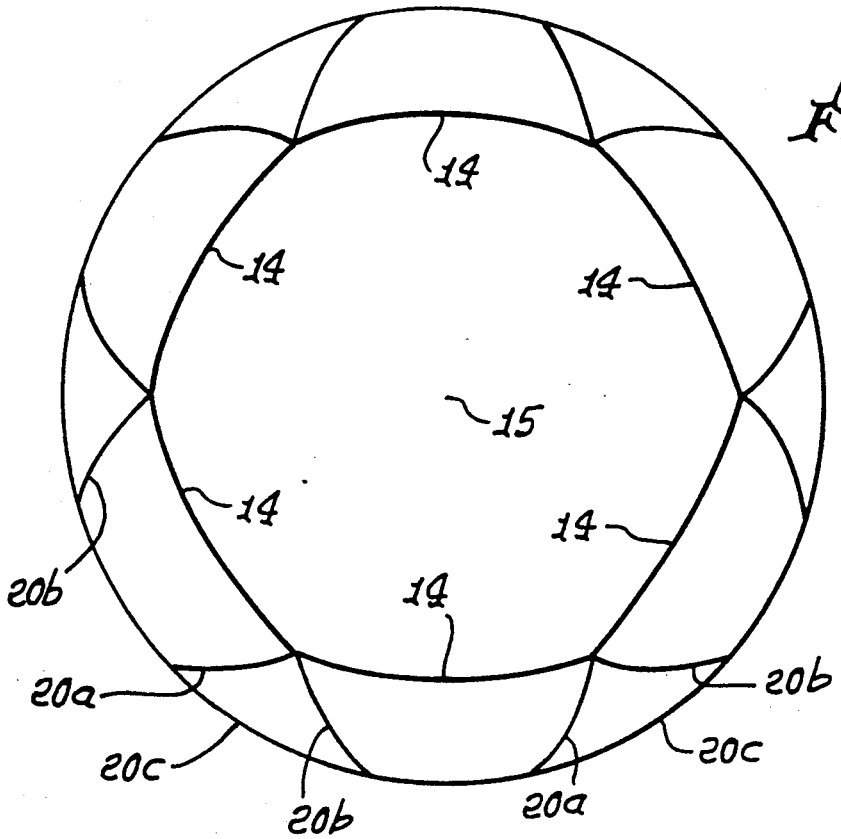

Smaller dimples are also located within the constraining patterns of arcs, as shown. Thus, smaller dimples 16c lie about the equator, substantially within the triangles $T_1$ and $T_2$ whose apices lie on the equator; and each trianglar group of such smaller dimples includes eight such dimples. The total number of such smaller dimples in the triangles $T_1$ and $T_2$ at each side of the equator is 48, satisfying the formula $6^2+2\times6$. Only a portion of these is visible in FIG. 2, the balance being on the opposite or back side of the ball sphere As referred to above, optimum distance for a golf ball is achieved when a minimum of about 75% and a maximum of about 85% of its spherical surface is covered with dimples, and more specifically, when a minimum of about 78% and a maximum of about 82% of its surface is covered with dimples. This coverage may be achieved with a multitude of different dimple sizes all of which will be in the range of diameters of about 0.110 inches to about 0.160 inches, and which have a specific ratio of depth to diameter for a given dimple size with the smaller dimples being deeper and having a higher depth to diameter ratio than the larger dimples.

As referred to, the described ball has a total of 458 dimples.

I claim:

1. In a golf ball characterized by enhanced flight distance and enhanced aerodynamic symmetry, the ball having a generally spherical surface with dimple pattern thereon, the improvement comprising:

a) between about 75% and 85% of the ball spherical surface occupied by the dimples, b) there being dimples of at least two different diameters, all of which have diameters within the range of 0.110 to 0.160 inches, c) there being multiple dimple intersecting segments or arcs of great circles on the ball surface, which define six-sided spherical surface hexagons associated with axially opposite polar zones, d) and there being 24 of the smaller dimples within each of said hexagons, e) the smaller dimples within each said hexagon grouped in clusters symmetrically spaced about an axis of said ball centrally intersecting said hexagons, f) the ball also having an equator, and certain of said segments or arcs of great circles also defining multiple spherical surface triangles with legs on said equator, and legs coincident with said sides of said hexagon, g) and wherein there are six of said clusters equally spaced about said axis, in each hexagon, each said cluster comprising four dimples.

2. The improvement of claim 1 wherein smaller dimples have a larger depth to diameter ratio than larger dimples.

3. The improvement of claim 2 wherein between 78% and 82% of the ball surface is occupied by said dimples.

4. The improvement of claim 1 wherein there are exactly 458 of said dimples on the ball.

5. The improvement of claim 1 wherein said smaller dimples have a ratio of depth-to-diameter of 0.055, and said larger dimples have a ratio of depth-to-diameter of 0.047.

6. The improvement of claim 1 wherein said equator is nearly everywhere adjacent smaller dimples.

7. The improvement of claim 1 wherein there are 144 smaller dimples, and 314 larger dimples on the ball.

* * * * *